US005761572A

United States Patent [19]

Watanabe et al.

[11] Patent Number: 5,761,572

[45] Date of Patent: Jun. 2, 1998

[54] IMAGE FORMING APPARATUS HAVING A TRANSFERRING UNIT IMPROVED IN OPERATIONAL TIMING

[75] Inventors: Masaru Watanabe; Hiroyuki Hazama; Takashi Terada, all of Osaka, Japan

[73] Assignee: Mita Industrial Co., Ltd., Osaka, Japan

[21] Appl. No.: 755,612

[22] Filed: Nov. 25, 1996

[30] Foreign Application Priority Data

Nov. 30, 1995 [JP] Japan ..... 7-311888

[51] Int. Cl.[6] ..... G03G 15/16

[52] U.S. Cl. ..... 399/66; 399/51; 399/150; 399/314; 430/126

[58] Field of Search ..... 399/43, 51, 66, 399/149, 150, 388, 314, 397; 430/126

[56] References Cited

U.S. PATENT DOCUMENTS 5,436,700 7/1995 Kikuchi et al. ..... 399/150 X 5,598,256 1/1997 Kimura et al. ..... 399/66 X 5,610,697 3/1997 Arai ..... 399/149

*Primary Examiner*—Arthur T. Grimley

*Assistant Examiner*—Sophia S. Chen

*Attorney, Agent, or Firm*—Beveridge, Degrandi, Weilacher & Young, LLP

[57] ABSTRACT

An image forming apparatus including a photoreceptor, an electrically charging unit for evenly electrically charging the photoreceptor to a predetermined potential, a light exposure unit for exposing a surface portion of the evenly electrically charged photoreceptor to light so as to form an electrostatic latent image, a developing unit for causing toner to adhere to the photoreceptor surface portion exposed to light so as to develop the electrostatic latent image into a toner image, and a transferring unit to which a predetermined transferring voltage is applied for transferring the toner image to a sheet. Before the tip end of the toner image reaches the position opposite to the transferring unit but after the tip end of the sheet has reached the position opposite to the transferring unit, the application of the predetermined transferring voltage to the transferring unit is started.

5 Claims, 5 Drawing Sheets

Prior Art

IMAGE FORMING APPARATUS HAVING A TRANSFERRING UNIT IMPROVED IN OPERATIONAL TIMING

BACKGROUND OF THE INVENTION

Field of the Invention

The present invention relates to an electrophotographic image forming apparatus such as a copying machine, a printer, a facsimile or the like of the electrophotographic type, and more particularly to an image forming apparatus arranged such that the developing device collects toner remaining on the photoreceptor after image transfer.

Description of the Related Art

There has been known an electrophotographic image forming apparatus using non-magnetic one-component toner as a developing agent. In such apparatus, a developing roller is generally used for developing an electrostatic latent image formed on the photoreceptor drum and there is adopted a contact developing method in which the developing roller comes in contact with the surface of the photoreceptor drum. Further, the developed toner image is transferred from the photoreceptor drum surface to a paper sheet, but residual toner adheres to the photoreceptor drum surface after image transfer. Such residual toner is collected by a cleaning device in many apparatuses of the type. However, to make the whole apparatus in a compact design, there is also known apparatus of a so-called cleaningless type incorporating no cleaning device.

FIG. 3 shows the outline of a so-called cleaningless-type apparatus using both non-magnetic one-component toner as a developing agent and a contact developing method with the use of a developing roller.

A photoreceptor drum 30 is rotated at a constant speed in a direction shown by an arrow 31. A corona discharger 32, a light exposure device 33, a developing roller 34, a transferring corona discharger 35 and a brush 36 are disposed around the photoreceptor drum 30 along the rotation direction 31 thereof. When the corona discharger 32 discharges electricity, the surface portion of the photoreceptor drum 30 opposite thereto is electrically charged to a predetermined potential. When the photoreceptor drum 30 is rotated in the direction of the arrow 31, its electrically charged surface portion is exposed, by the light exposure device 33, to light corresponding to the document image. Thus, an electrostatic latent image is formed on the surface portion of the photoreceptor drum 30.

When the photoreceptor drum 30 is further rotated, the electrostatic latent image thereon comes in contact with the developing roller 34 and is developed by non-magnetic onecomponent toner. When the toner image thus formed is brought to the position opposite to the transferring corona discharger 35, the toner image is transferred to a delivered paper sheet.

Generally, residual toner particles adhere to the surface of the photoreceptor drum 30 after the toner image thereon has been transferred. Also, paper powder from paper adheres to the surface of the photoreceptor drum 30. The brush 36 is disposed for disjointing toner adhering to the surface of the photoreceptor drum 30 and for collecting such paper powder. The term "disjointing" means weakening the strong electrostatic coupling, on the surface of the photoreceptor drum 30, between toner and the electric charge on the drum surface. To enhance the toner disjointing effect and to improve the paper powder collecting efficiency, a predetermined bias voltage is usually applied to the brush 36.

When disjointing the residual toner by the brush 36, a portion of the residual toner also adheres to the brush 36. Such adhering is different from attraction of paper powder. That is, toner is not positively attracted by the brush 36, but naturally adheres thereto because the brush 36 comes in contact with the surface of the photoreceptor drum 30.

On the surface portion of the photoreceptor drum 30 which has passed through the brush 36, the electrostatic coupling between the toner and the electric charge on the drum surface is weakened such that the toner particles loosely electrostatically adhere to the surface portion of the photoreceptor drum 30.

When brought to the position opposite to the corona discharger 32, that surface portion of the photoreceptor drum 30 in the state above-mentioned is again electrically charged to a predetermined high potential for the next image forming. Then, this surface portion of the photoreceptor drum 30 is exposed to light corresponding to the image by the light exposure device 33 and moved to the position opposite to the developing roller 34. At this time, the residual toner on the photoreceptor drum 30 is small in amount and is being disjointed by the brush 36. This does not disturb the formation of an electrostatic latent image when the photoreceptor drum 30 is again electrically charged by the corona discharger 32 and exposed to light by the light exposure device 33.

When the residual toner on the photoreceptor drum 30 reaches the position opposite to the developing roller 34, the residual toner is collected as pulled toward the developing roller 34 by a coulomb force generated due to a difference in potential between the bias voltage applied to the developing roller 34 and the potential of the photoreceptor surface. At the same time, the developing roller 34 develops the electrostatic latent image into a toner image.

Thus, by arranging to collect residual toner by the developing roller 34, a so-called cleaningless structure is achieved in the contact developing method using the developing roller 34.

In the arrangement as shown in FIG. 3, changes in surface potential of the photoreceptor drum 30 at the position opposite to the transferring corona discharger 35, are shown in FIG. 4. In FIG. 4, the axis of ordinate shows the surface potential of the photoreceptor drum 30, while the axis of abscissa shows time. The changes in surface potential of the photoreceptor drum 30 are caused by the corona discharger 32 and the transferring corona discharger 35. Accordingly, FIG. 4 also shows the on-timings of both the corona discharger 32 and the transferring corona discharger 35. FIG. 4 also shows the moving state of a paper sheet delivered to the position opposite to the transferring corona discharger 35.

First, when the corona discharger 32 is turned on to start discharging electricity, the surface portion of the photoreceptor drum 30 opposite thereto is electrically charged to a high potential H. If not exposed to light, this surface portion of the photoreceptor drum 30 is rotated, with the surface potential unchanged, to the position opposite to the transferring corona discharger 35 after a predetermined period of time. For simplification, it is now supposed that dark attenuation on the drum surface or the like is not taken into consideration.

On the other hand, a paper sheet is delivered such that the tip end of the toner image formed on the photoreceptor drum 30 corresponds to the tip end of the paper sheet. To securely transfer the toner image to the paper sheet, particularly to prevent the tip portion of the toner image from being defectively transferred, the transferring corona discharger 35 is turned on a predetermined period of time earlier before the delivered paper sheet reaches the position opposite to the transferring corona discharger 35. Thus, the transferring corona discharger 35 starts discharging electricity, for example negative electricity, of which polarity is opposite to that of the electricity discharged by the corona discharger 32. At this time, the discharge of the transferring corona discharger 35 lowers, to a potential L, the surface potential of the photoreceptor drum 30 opposite thereto. Thereafter, when the paper sheet reaches the position opposite to the transferring corona discharger 35, the electric charges discharged by the transferring corona discharger 35 cause the paper sheet to be negatively electrically charged. This reduces the rate of the electric charges which reach directly the photoreceptor drum 30. Accordingly, the drum surface potential is raised from the potential L to a potential M.

The drum surface portion presenting the potential L becomes a slender band-like low-potential surface portion extending in the axial direction of the photoreceptor drum 30. When the portion presenting the potential L becomes opposite to the brush 36, the residual toner adhering to the brush 36 is electrostatically sucked by the portion presenting the potential L. As a result, an undesired band-like toner image is formed on the surface of the photoreceptor drum 30, and this toner image appears on the next image. More specifically, as shown in FIG. 5, a black band 37 (shown by hatching) is disadvantageously generated on a paper sheet to which the next image is being transferred.

Disadvantageously, this phenomenon increasingly appears as toner adhering to the brush 36 is increased in amount with the use.

SUMMARY OF THE INVENTION

It is a first object of the present invention to provide an image forming apparatus capable of forming an image improved in quality.

It is a second object of the present invention to provide, as an image forming apparatus in which non-magnetic one-component toner is used as a developing agent, in which a contact developing method using a developing roller is adopted and in which a so-called cleaningless structure is achieved, an image forming apparatus so arranged as to prevent an undesired band-like portion as mentioned earlier from being generated on a formed image.

It is a third object of the present invention to provide an image forming apparatus controlling method capable of forming an image improved in quality.

The image forming apparatus according to the present invention is arranged such that a toner image formed on the surface of a photoreceptor is transferred to a sheet by a transferring unit. The application of a transferring voltage to the transferring unit is started before the tip end of the toner image reaches the position opposite to the transferring unit but after the tip end of the sheet has reached the position opposite to the transferring unit. Accordingly, the toner image is securely transferred to the sheet without the tip portion of the toner image defectively transferred.

According to an embodiment of the present invention, the application of the predetermined transferring voltage to the transferring unit is stopped before the rear end of the sheet reaches the position opposite to the transferring unit but after the rear end of the toner image has reached the position opposite to the transferring unit. Accordingly, the toner image is securely transferred to the sheet without the rear portion of the toner image defectively transferred.

The image forming apparatus may include an electrically charging unit for evenly electrically charging the photoreceptor to a predetermined potential, a light exposure unit for exposing a surface portion of the evenly electrically charged photoreceptor to light, thereby to form an electrostatic latent image, and a developing unit for causing toner to adhere to the photoreceptor surface portion exposed to light, thereby to develop the electrostatic latent image into a toner image. In such an arrangement, the light exposure timing of the light exposure unit is preferably controlled such that there is formed an image zone shorter in length than the sheet on which an image is to be formed.

The image forming apparatus may include a brush for disjointing residual toner remaining on the photoreceptor surface after image transfer. For example, while the transferring unit discharges negative electricity, a sheet is interposed between the transferring unit and the photoreceptor. Accordingly, the sheet prevents, to some extent, the negative electric charges discharged by the transferring unit from reaching the photoreceptor surface. Thus, the electric charges on the photoreceptor surface are not neutralized. This lowers the reduction amount of the surface potential of the photoreceptor due to the discharge of the transferring unit. Accordingly, even though a large amount of residual toner is adhering to the brush, the residual toner is not electrostatically sucked by the photoreceptor surface. Therefore, an undesired image such as a black band or the like is not formed on a sheet.

Preferably, the developing unit has a function of collecting residual toner on the photoreceptor surface.

An image forming apparatus controlling method of the present invention includes the steps of: controlling a toner image forming unit such that there is formed an image zone shorter in length than a sheet on which an image is to be formed; and starting the application of a predetermined transferring voltage to the transferring unit before the tip end of a toner image reaches the position opposite to the transferring unit but after the tip end of the sheet has reached the position opposite to the transferring unit. An embodiment of the image forming apparatus controlling method of the present invention, further includes the step of stopping the application of the predetermined transferring voltage to the transferring unit before the rear end of the sheet reaches the position opposite to the transferring unit but after the rear end of the toner image has reached the position opposite to the transferring unit.

These and other features, objects and advantages of the present invention will be more fully apparent from the following detailed description set forth below when taken in conjunction with the accompanying drawings.

BRIEF DESCRIPTION OF THE DRAWINGS

FIG. 4 shows changes in surface potential of the photoreceptor at the time when the corona discharger and the transferring corona discharger are turned on.

DESCRIPTION OF THE PREFERRED EMBODIMENTS

Figure 1:
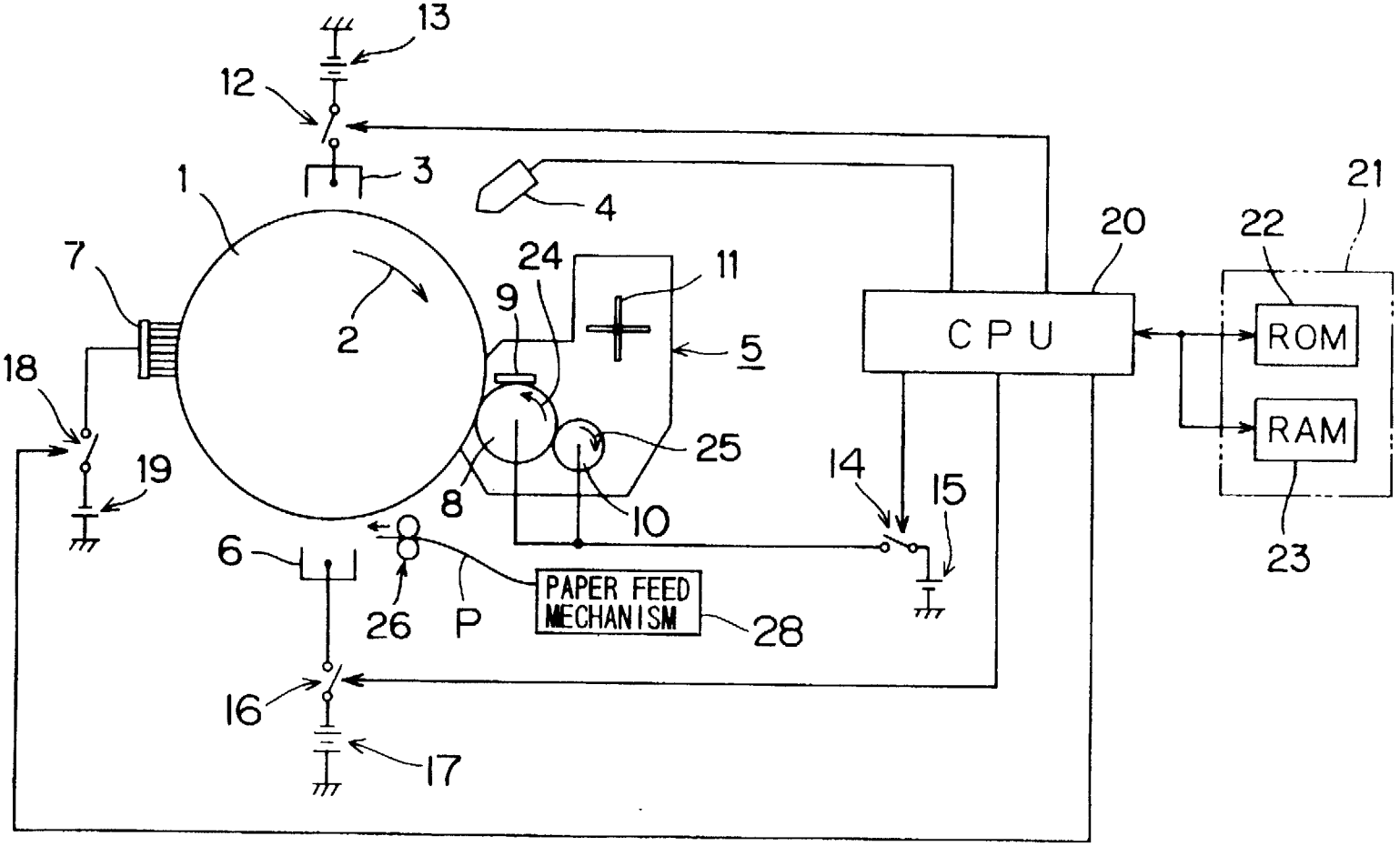
FIG. 1 is a block diagram illustrating the arrangement of main portions of an image forming apparatus according to an embodiment of the present invention.

FIG. 1 is a block diagram illustrating the arrangement of main portions of an image forming apparatus according to an embodiment of the present invention, and more specifically shows the arrangement of the image forming unit of a printer. This printer has a photoreceptor drum 1 to be rotated at a constant speed in the direction shown by an arrow 2. A corona discharger 3, a light exposure unit 4, a developing unit 5, a transferring corona discharger 6 and a paper powder collecting brush 7 are disposed around the photoreceptor drum 1 along its rotation direction 2. The corona discharger 3, the light exposure unit 4 and the developing unit 5 form toner image forming means.

The corona discharger 3 is connected to a high voltage power source 13 through a charging switch 12. When the charging switch 12 is turned on and the high voltage power source 13 applies a positive high voltage to the corona discharger 3, the corona discharger 3 starts discharging electricity to uniformly electrically charge, to a predetermined potential A, the surface portion of the photoreceptor drum 1 opposite to the corona discharger 3. With the rotation of the photoreceptor drum 1, the electrically charged surface portion thereof is brought to the position opposite to the light exposure unit 4. The light exposure unit 4 emits light based on the data of an image to be formed, causing the surface portion of the photoreceptor drum 1 to be exposed to the light. The electric charges on the exposed-to-light portion get away such that the potential thereof becomes a potential B lower than the potential A above-mentioned. Accordingly, there are generated, on the surface of the photoreceptor drum 1, a zone presenting a high potential and a zone presenting a low potential, such that a so-called electrostatic latent image is formed.

Then, that surface portion of the photoreceptor drum 1 on which the electrostatic latent image is being formed, is brought to the position opposite to the developing unit 5. The developing unit 5 includes a developing roller 8 so disposed as to come in contact with the surface of the photoreceptor drum 1, a thin-layer blade 9, a sub-roller 10 and a stirrer 11. The stirrer 11 is arranged to stir the toner in the developing unit 5 such that the developing roller 8 and the sub-roller 10 evenly receive toner. The developing roller 8 and the sub-roller 10 are respectively rotated in the directions shown by arrows 24, 25. This causes the toner to be electrically charged due to frictional electrification against the developing roller 8 and the sub-roller 10. The toner is non-magnetic one-component toner and positively electrically charged by this frictional electrification. Electrically charged toner mainly adheres to the surface of the developing roller 8, and the rotation of the sub-roller 10 helps toner to adhere to the surface of the developing roller 8. The toner adhering to the surface of the developing roller 8 is made in the form of a thin layer having a thickness regulated to a predetermined value by the thin-layer blade 9.

On the other hand, the developing roller 8 and the sub-roller 10 are connected to a power source 15 through a developing switch 14. When the developing switch 14 is turned on, a positive voltage is applied to the developing roller 8 and the sub-roller 10. The magnitude of this voltage is set such that the potential C of the developing roller 8 is lower than the potential A of the portion of the photoreceptor drum 1 which is not exposed to light, and is higher than the potential B of that portion of the photoreceptor drum 1 which is exposed to light and of which surface potential is therefore lowered.

The developing roller 8 on which a toner layer is being formed, is rotated at a speed faster than the peripheral speed of the photoreceptor drum 1. This causes the toner layer to come in contact with the electrostatic latent image formed on the surface of the photoreceptor drum 1. When the electrostatic latent image comes in contact with the toner layer, positively electrically charged toner on the developing roller 8 is moved to that portion of the photoreceptor drum 1 relatively low in potential. More specifically, the toner adheres to the exposed-to-light portion which is lower in potential than the developing roller 8 and does not adhere to the unexposed-to-light portion which is higher in potential than the developing roller 8. Thus, the electrostatic latent image is developed into a toner image.

Then, the photoreceptor drum 1 is further rotated. At timing in synchronism with the movement of the toner image to the position opposite to the transferring corona discharger 6, registration rollers 26 disposed in the vicinity of the photoreceptor drum 1 are rotationally driven to supply a paper sheet P. Paper sheets are supplied, one by one, from a paper feed mechanism 28 toward the registration rollers 26.

The transferring corona discharger 6 is connected to a high voltage power source 17 through a transfer switch 16. When the transfer switch 16 is turned on, a negative voltage is applied. The transferring corona discharger 6 to which a negative voltage is being applied, discharges negative electricity such that a fed paper sheet P is negatively electrically charged. The toner adhering to the surface of the photoreceptor drum 1 electrostatically adheres to the negatively electrically charged paper sheet P. After transfer to the paper sheet P in the manner abovementioned, the toner image is fixed thereto by a fixing unit (not shown).

A portion of the toner is not transferred to the paper sheet P and remains on the surface of the photoreceptor drum 1 from which the toner image has been transferred. In addition to such untransferred toner, paper powder or the like adheres to the surface of the photoreceptor drum 1.

The photoreceptor drum 1 is further rotated such that the portion thereof to which the residual toner is adhering comes in contact with the paper powder collecting brush 7. The paper powder collecting brush 7 disturbs the residual toner, causing the same to be disjointed. The paper powder collecting brush 7 is connected to a power source 19 through a brush switch 18. When the brush switch 18 is turned on, a negative voltage is applied to the paper powder collecting brush 7. This causes the residual toner to be electrically disjointed. Simultaneously, the paper powder collecting brush 7 physically and electrically collects paper powder adhering to the surface of the photoreceptor drum 1.

While the residual toner weakened in electrostatic adhesive force with respect to the photoreceptor drum surface remains adhering thereto, that surface portion of the photoreceptor drum 1 from which paper powder has been removed, is brought again to the position opposite to the corona discharger 3 and evenly electrically charged for forming the next image. Then, the photoreceptor drum 1 is exposed to light by the light exposure unit 4. The residual toner adhering to the surface of the photoreceptor drum 1 is small in amount and scattered. Accordingly, the residual toner does not influence the electric charging of the photoreceptor drum 1 by the corona discharger 3 and the light exposure thereof by the light exposure unit 4.

After light exposure, the exposed-to-light surface portion of the photoreceptor drum 1 is brought to the position opposite to the developing unit 5. At the developing unit 5, the electrostatic latent image is developed to a toner image as mentioned earlier and there is collected the residual toner which has not been transferred to the paper sheet P at the previous image forming and which is adhering to this surface portion of the photoreceptor drum 1. Since the residual toner has been disjointed by the paper powder collecting brush 7 to weaken its electrostatic adhesive force with respect to the photoreceptor drum 1, the residual toner is collected as drawn toward the developing roller 8 presenting a potential C lower than the surface potential A of the photoreceptor drum 1.

This printer also includes a CPU 20 connected to a memory 21 having a ROM 22 and a RAM 23. The CPU 20 controls the operation of each component of the printer according to the program stored in the ROM 22. At predetermined timings to be discussed later, the CPU 20 turns, to on/off, the charging switch 12, the developing switch 14, the transfer switch 16 and the brush switch 18 which respectively control the voltage application to the corona discharger 3, the developing roller 8, the transferring corona discharger 6 and the paper powder collecting brush 7. The light exposure unit 4 is connected to the CPU 20, which controls the light emission of the light exposure unit 4.

Figure 2:
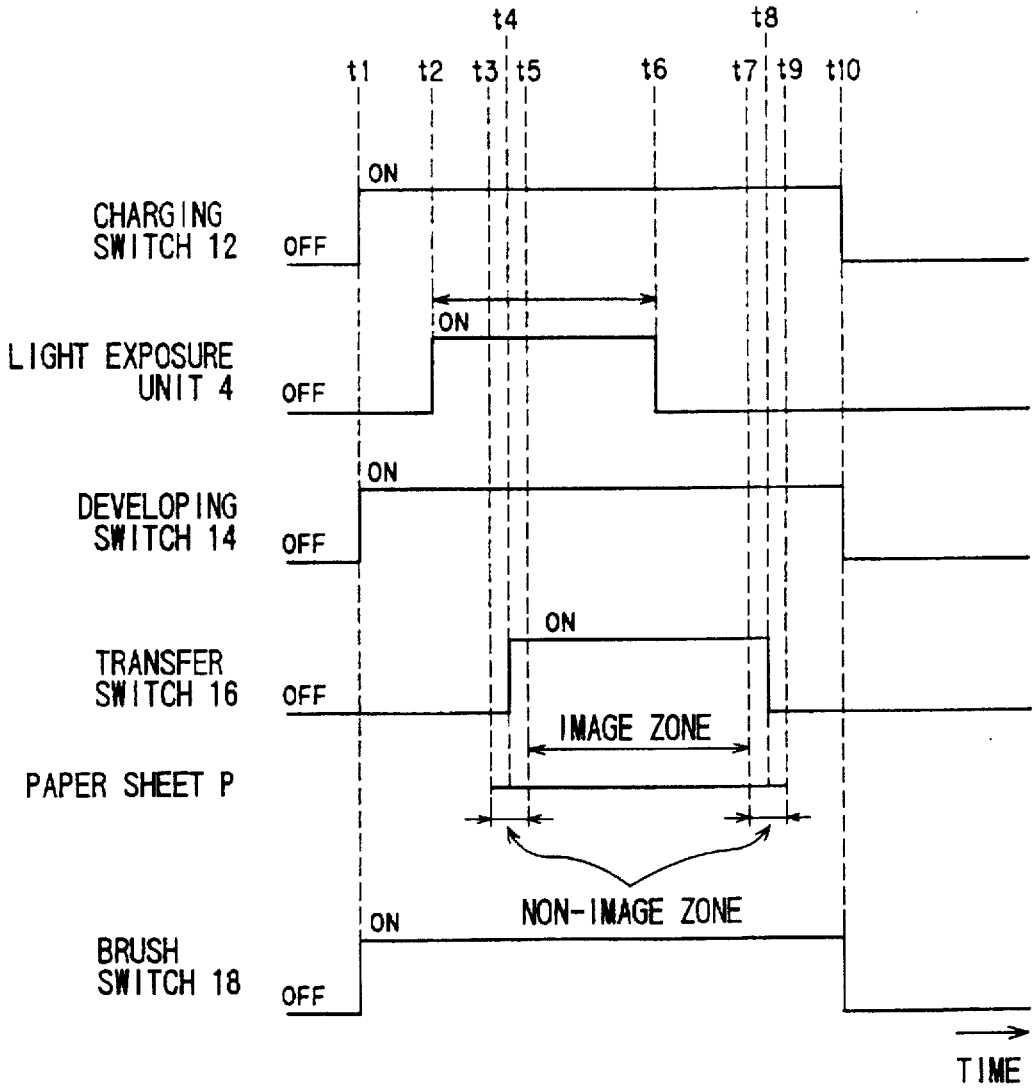
FIG. 2 is a time chart illustrating the control executed by the CPU.
Figure 3:
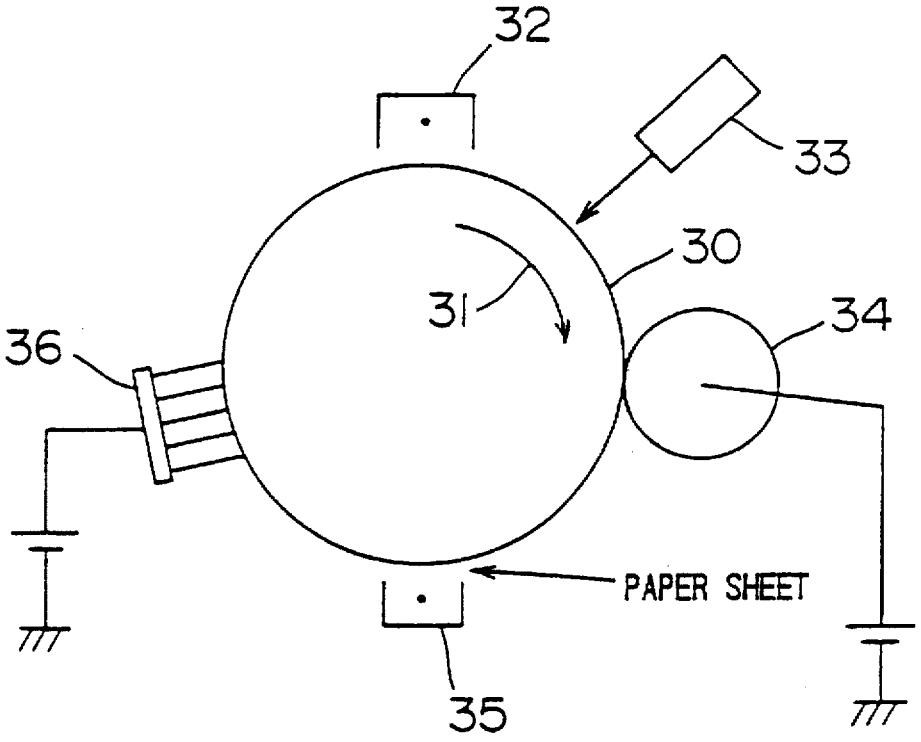
FIG. 3 is a schematic section view illustrating the outline of a cleaningless-type apparatus of the prior art.
Figure 4:
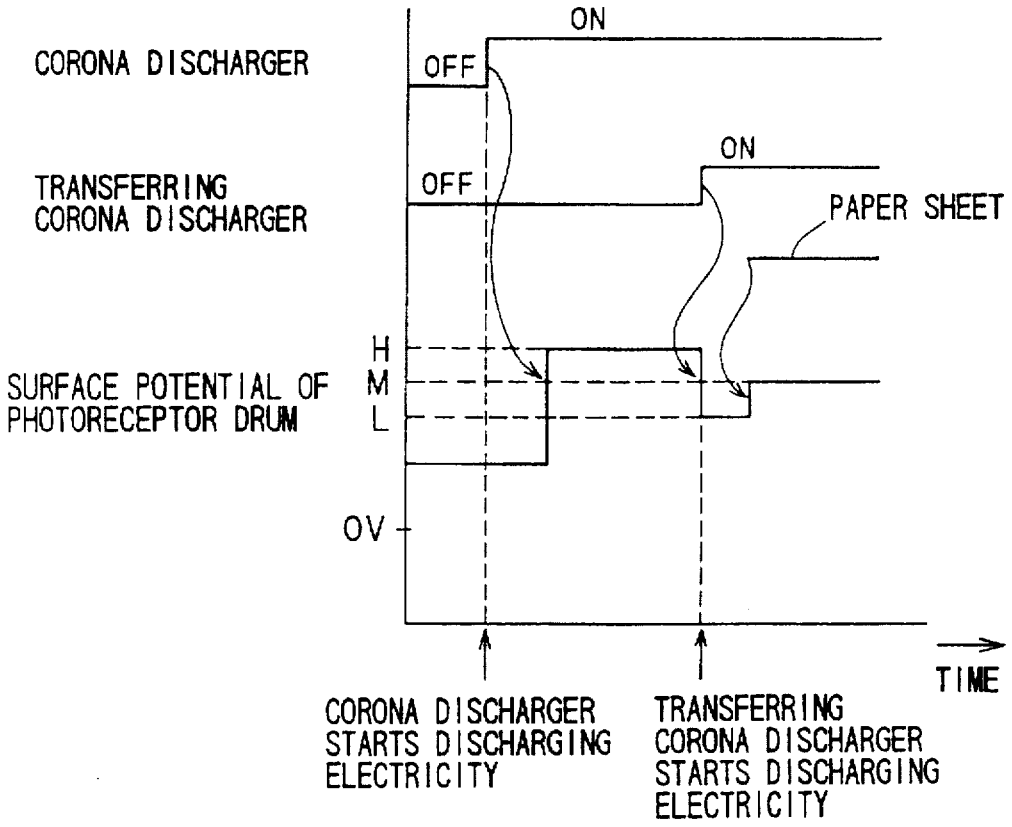
Figure 5:
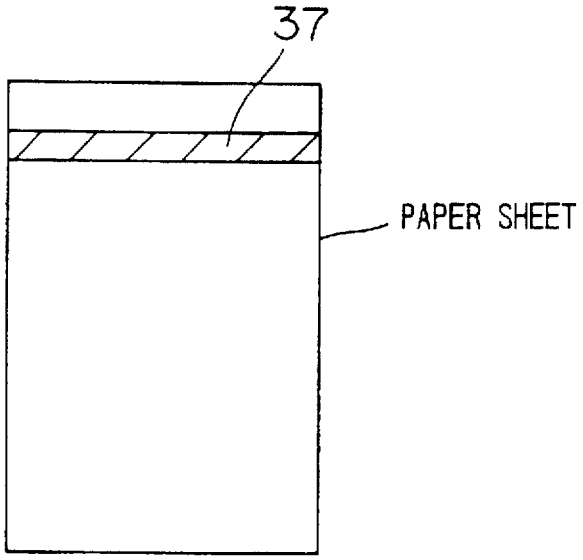
FIG. 5 shows a black band generated on a paper sheet.

FIG. 2 is a time chart illustrating the contents of control by the CPU 20. With reference to FIG. 2, the following description will discuss the operational timings in one cycle of image formation by the printer having the arrangement above-mentioned. When the image formation operation starts and the photoreceptor drum 1 starts rotating, the charging switch 12 is turned on such that a positive voltage is applied to the corona discharger 3 (t1). As a result, the photoreceptor drum 1 starts to be positively electrically charged from the portion opposite to the corona discharger 3 at that time. At the same time, the developing switch 14 and the brush switch 18 are turned on such that bias voltages are respectively applied to the developing roller 8 and the paper powder collecting brush 7 (t1).

Thereafter, at predetermined timing t2, the light exposure unit 4 emits light based on an image to be formed, thereby to start exposing a surface portion of the photoreceptor drum 1 to light. With the rotation of the photoreceptor drum 1, an image of its exposed-to-light portion is successively developed, starting with the tip end, by toner at the developing unit 5. That is, a toner image is formed on the surface of the photoreceptor drum 1.

On the other hand, a paper sheet P is supplied (t3) to the transferring corona discharger 6 substantially in synchronism with the arrival of the tip end of the toner image at the transferring corona discharger 6. More specifically, the paper sheet P is supplied such that the tip thereof reaches the transferring corona discharger 6 slightly earlier before the tip end of the toner image reaches the transferring corona discharger 6 (t5). Further, before the tip end of the toner image reaches the transferring corona discharger 6 but after the tip end of the paper sheet P has reached the transferring corona discharger 6, the transfer switch 16 is turned on to apply a negative voltage to the transferring corona discharger 6 (t4). As a result, the toner image is transferred to the paper sheet P without the tip end of the toner image defectively transferred.

After the passage of a predetermined period of time (t6) from the start of light exposure (t2), the light exposure of the photoreceptor drum surface by the light exposure unit 4 is finished. The period of time from the start of light exposure to the completion of light exposure (t2–t6) is controlled such that zone of the paper sheet P to which the toner image is to be transferred (image zone) is shorter in length than the paper sheet P. After the passage of a predetermined period of time (t7) from the completion of light exposure by the light exposure unit 4, the rear end of the toner image reaches the transferring corona discharger 6, thus finishing the transfer of the toner image to the paper sheet P. Before the rear end of the paper sheet P reaches the transferring corona discharger 6 (t9) but after the rear end of the toner image reaches the discharger 6, the transfer switch 16 is turned off to stop the application of a voltage to the transferring corona discharger 6 (t8). This prevents the rear end of the toner image from being defectively transferred. After the passage of a predetermined period of time (t10), the charging switch 12, the developing switch 14 and the brush switch 18 are turned off to finish the image forming operation.

As discussed in the foregoing, the period of time of light exposure of the photoreceptor drum surface by the light exposure unit 4, is controlled such that the electrostatic latent image formed by the light exposure is shorter in length than the paper sheet P. Further, a paper sheet P is delivered such that the tip end of the paper sheet P reaches the position opposite to the transferring corona discharger 6 slightly earlier before the tip end of the toner image formed on the surface of the photoreceptor drum 1 reaches the position opposite to the transferring corona discharger 6. Accordingly, there are formed, on the paper sheet P, an image zone to which a toner image is being transferred, and nonimage zones which are located in the vicinity of the tip and rear ends of the paper sheet P and to which no image is being transferred.

When transferring the toner image to the paper sheet P, the transfer switch 16 is turned on before the tip end of the toner image formed on the surface of the photoreceptor drum 1 reaches the position opposite to the transferring corona discharger 6 but after the tip end of the paper sheet P has reached the position opposite to the transferring corona discharger 6. This prevents the tip portion of the toner image from being defectively transferred. The transfer switch 16 is turned off before the rear end of the paper sheet P reaches the position opposite to the transferring corona discharger 6 but after the rear end of the toner image has reached the position opposite to the transferring corona discharger 6. This also prevents the rear end portion of the toner image from being defectively transferred.

While the transferring corona discharger 6 discharges electricity, a paper sheet is interposed between the transferring corona discharger 6 and the photoreceptor drum 1. Accordingly, the paper sheet P prevents, to some extent, the negative electric charges discharged by the transferring corona discharger 6 from reaching the surface of the photoreceptor drum 1. Thus, the electric charges on the surface of the photoreceptor drum 1 are not neutralized. This lowers the surface potential reduction amount of the photoreceptor drum 1 by the discharge of the transferring corona discharger 6. Accordingly, even though residual toner is collected by the paper powder collecting brush 7, the residual toner is not electrostatically sucked to the surface of the photoreceptor drum 1. Therefore, an undesired image such as a black band or the like is not formed on a paper sheet P.

The description above-mentioned has been made with a printer taken as an example. However, the present invention may widely be applied to apparatus for electrophotographically forming an image. Examples of such apparatus include a copying machine, a facsimile and the like.

Thus, an embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A method of controlling an image forming apparatus in which a toner image formed on a surface of a photoreceptor by toner image forming means is transferred to a sheet by transferring means, the method comprising the steps of:

controlling the toner image forming means such that an image zone shorter in length than the sheet on which an image is to be formed is provided;

starting the application of a predetermined transferring voltage to the transferring means before a tip end of the toner image reaches a position opposite to the transferring means but after a tip end of the sheet has reached the position opposite to the transferring means; and stopping the application of the predetermined transferring voltage to the transferring means before the rear end of the sheet reaches the position opposite to the transferring means but after the rear end of the toner image has reached the position opposite to the transferring means.

2. An image forming apparatus for forming an image on a sheet, comprising:

a photoreceptor;

electrically charging means for evenly electrically charging the photoreceptor to a predetermined potential;

light exposure means for exposing a surface portion of the evenly electrically charged photoreceptor to light, thereby to form an electrostatic latent image;

developing means for causing toner to adhere to the photoreceptor surface portion exposed to light, thereby to develop the electrostatic latent image into a toner image;

transferring means, to which a predetermined transferring voltage is applied, for transferring the toner image to a sheet which is delivered;

means for starting the application of the Predetermined transferring voltage to the transferring means before a tip end of the toner image reaches a position opposite to the transferring means but after a tip end of the sheet has reached the position opposite to the transferring means; and means for stopping the application of the predetermined transferring voltage to the transferring means before a rear end of the sheet reaches the position opposite to the transferring means but after a rear end of the toner image has reached the position opposite to the transferring means.

3. An image forming apparatus according to claim 2, further comprising means for controlling a light exposure timing of the light exposure means such that an image zone shorter in length than the sheet on which an image is to be formed is provided.

4. An image forming apparatus according to claim 2, further comprising a brush for disjointing residual toner remaining on the photoreceptor surface portion after image transfer.

5. An image forming apparatus according to claim 2, wherein the developing means also has a function of collecting residual toner on the photoreceptor surface.

* * * * *